US008727950B2

(12) United States Patent
Carter

(10) Patent No.: US 8,727,950 B2
(45) Date of Patent: May 20, 2014

(54) EXERCISE DEVICE FOR USE WITH A PROSTHESIS

(76) Inventor: Andrew C. Carter, Los Angeles, CA (US)

( * ) Notice: Subject to any disclaimer, the term of this patent is extended or adjusted under 35 U.S.C. 154(b) by 239 days.

(21) Appl. No.: 12/792,634

(22) Filed: Jun. 2, 2010

(65) Prior Publication Data

US 2011/0301718 A1 Dec. 8, 2011

(51) Int. Cl.
*A63B 23/12* (2006.01)

(52) U.S. Cl.
USPC ..... 482/93; 623/31; 482/105; 482/139; 602/62; 601/23

(58) Field of Classification Search
USPC ..... 602/60–64, 75, 5, 20, 21; 601/5, 23, 33; 623/57, 58, 31–33; 482/92, 124, 139, 482/148
See application file for complete search history.

(56) References Cited

U.S. PATENT DOCUMENTS 2,980,426 A * 4/1961 Johnson ..... 473/63
3,934,583 A * 1/1976 Hollingshead et al. ..... 602/62
4,156,425 A * 5/1979 Arkans ..... 601/152
4,258,441 A * 3/1981 Bell ..... 623/64
4,949,957 A * 8/1990 Cucchiara ..... 482/93
D353,005 S * 11/1994 Glidden ..... D24/190
5,662,595 A * 9/1997 Chesher et al. ..... 602/20
5,891,079 A * 4/1999 Barnes ..... 602/61
6,117,097 A * 9/2000 Ruiz ..... 602/26
2002/0169407 A1 * 11/2002 Glinsboeckel ..... 602/64
2008/0287840 A1 * 11/2008 Koscielny et al. ..... 601/23

* cited by examiner

*Primary Examiner* — Marcia Hoffman
(74) *Attorney, Agent, or Firm* — Venable LLP; Stefan J. Kirchanski

(57) ABSTRACT

The present invention provides an armband designed for wearing by a person who uses a hand prosthesis or a person with impaired hand function. The armband both stabilizes the attachment of the prosthesis thereby allowing pulling exercises that would otherwise be impossible and provides connection to exercise machines allowing the wearer to carry out exercises that would otherwise require the wearer to grasp an operational portion of the exercise machine. The armband is constructed from a sheet of flexible material that is sized to be wrapped around a wearer's arm enclosing substantially all of the arm and the wrist or base portion of any hand prosthesis. The wrapped armband is tightened by attached cinching straps and D-rings are provided attached to the surface of the armband for attachment of portions of exercise machines. An optional shoulder harness can be attached to the armband for additional stability.

8 Claims, 5 Drawing Sheets

EXERCISE DEVICE FOR USE WITH A PROSTHESIS

CROSS-REFERENCE TO PRIOR APPLICATIONS

Not Applicable

U.S. GOVERNMENT SUPPORT

Not Applicable

BACKGROUND OF THE INVENTION

1. Area of the Art

[Area of Art]

2. Description of the Background

In 1984 I was involved in an electrical accident that resulted in the amputation of my left hand and left wrist. Since then I have worn prosthetic devices, including an Otto Bock myoelectric hand for day-to-day use and a TRS Grip 2S prehensile device for use in exercise during gym visits and other heavy physical activity.

I have been a regular gym attendee for most of my adult life, and I gradually became more and more frustrated by my inability to perform a variety of upper-body exercises because of limitations caused by my prosthetic devices. While I was able to perform upper-body exercises that require a pushing motion (i.e. bench press or military press), I was unable to perform exercises that involve pulling towards me (i.e. rowing) or pulling down (i.e., lat pulldowns). Essentially, the prosthetic devices were not designed to withstand a pulling motion and would tend to detach from my forearm. In addition, I was unable to perform any kind of fly or reverse fly exercises with my left arm without causing significant pain to my left forearm caused by the inner shell of my prosthetic arm pushing against it. Again, while the prosthesis was designed for many exercises, it simply was not able to accommodate fly or reverse fly exercises.

After considerable thought and experimentation, I arrived at the device. As a result of using my new device, I can now perform all of the above exercises and make much fuller use of the gym than I could before. And while the device has been extremely effective in getting around the physical limitations of exercising with a prosthetic device, the same or similar device would also be useful for those who are in rehabilitation following any number of injuries and/or surgeries, or have a pre-existing condition such as arthritis or Carpal tunnel syndrome that interferes with a full or sustained grip.

In addition, there is an important aesthetic aspect to my invention. Over the space of almost 26 years as an amputee, I have come to realize that many prosthetic and orthotic devices and products, while utilitarian, are aesthetically lacking. My device also serves important and often overlooked stylistic and aesthetic purposes; in other words, it looks really good and is something that stands out in a positive way. This is an especially important psychological consideration for amputees dealing with the sudden change in their body and the resulting body image issues. I envision that each device can be custom-made, and as a result each wearer will be able to personalize his or her own device via choices of color for both leather/fabric and the metal hardware.

SUMMARY OF THE INVENTION

The present invention includes an armband designed for wearing by a person using a hand prosthesis or a person with impaired hand function. The armband stabilizes the attachment of the prosthesis thereby allowing pulling and numerous other exercises that would otherwise be impossible. In addition, the armband provides attachment points for operational portions of exercise machines thus allowing the wearer to perform exercises that would otherwise require the wearer to grasp those portions of the exercise machine with his or her hand. In one embodiment the armband device comprises a four-sided sheet of flexible material having an upper edge, a lower edge, a first side edge and a second side edge wherein a length from the upper edge to the lower edge is about equal to a length of the wearer's arm from shoulder to wrist. The four-sided sheet preferably is trapezoidal in shape with the upper edge essentially parallel to the lower edge. A first opening is cut through the four-sided sheet, deposed and sized to accommodate an outer surface of the wearer's elbow joint when the armband device is wrapped around the wearer's arm to ensure that the armband does not impair flexibility of the elbow joint. A first strip of hook-in-loop fastener is deposed along the first side edge of the four-sided sheet and a second strip of hook-in-loop faster complementary to the first strip is disposed along the second side edge so that when the device is wrapped around wearer's arm and possibly a portion of a prosthetic hand, the first strip and the second strip interact to hold the device in a wrapped position. To further tighten the device a plurality of cinching straps are provided with each strap extending from a fixed end attached to the four-sided sheet near the second side edge and running perpendicular to the longitudinal axis of the four-sided sheet to a free end near the first side edge. In addition, there are a plurality of cinching rings, at least one per cinching strap, each ring attached to the armband device and deposed so that pulling the free end of a cinching strap through its respective cinching ring tightens the device when the device is wrapped around a user's arm and a portion of a prosthetic hand if one is present. Finally, a plurality of attachment hardware, preferably D-rings, is deposed on the armband device to allow connection of the device with an operational portion of an exercise machine.

DETAILED DESCRIPTION OF THE INVENTION

Figure 1:
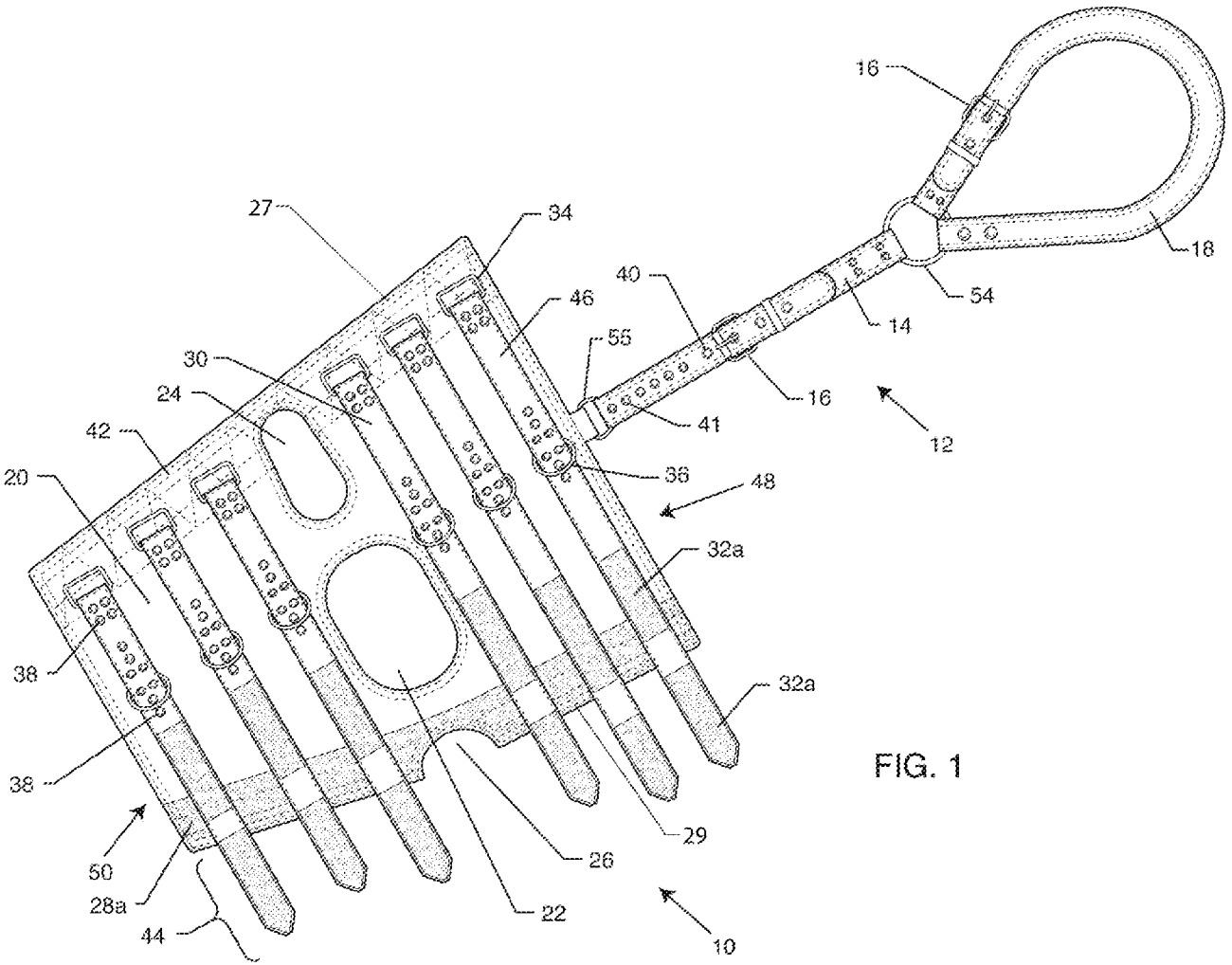
FIG. 1 shows a view of the top surface of the device in an unrolled condition.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a wearable device to adapt prosthetic limbs to weight lifting and similar physical exercise.

Development of the device. As I have already explained, I was frustrated by the inability of my prosthesis to accommodate certain exercises, particularly those that included a pulling movement. Eventually I realized that many exercises that I was currently unable to perform could be performed if I could create a strong, stable device linked in some way to my body and by means of which I could attach cables from a weight machine to my arm. Upon making this realization, I quickly realized that an armband-like device with metal D-rings or similar hardware would be an effective way to achieve this end. While my initial idea was for a cuff that would wrap around only the bicep, upon further reflection it became apparent to me that am armband that ran essentially the full length of the arm would be stronger, safer and more versatile. I decided that leather should be the base material because of its strength, durability and comfort, along with the fact that the armband would "break in" through regular use. Of course, any other flexible and inelastic material including high strength fabrics (such as those woven from Kevlar® brand of para-aramid synthetic fiber) as well as artificial leathers can be used.

Once I had a design in mind, I engaged a manufacturer that specializes in making leather clothing and accessories and who agreed to construct the armband according to my specifications. As shown in the figures and discussed in detail below, the device is tubular and encircles the entire arm from just below the shoulder to the vicinity of the wrist. A detachable shoulder harness is provided to prevent the armband from being inadvertently pulled off during use. The armband is furnished with D-rings or other such hardware for attaching weights or cables. By encircling the arm portion (but not the hand portion) of any prosthesis being worn, the connection between the prosthesis and the arm is significantly strengthened. While the initial armband did work as hoped, it quickly became apparent to me that two major improvements could be readily made: first, was the addition of a series of external straps that could be cinched tight so the armband could be more readily secured, and second, was the addition of an optional shoulder harness to prevent the armband from being pulled off during use.

With these improvements in mind I commissioned a revised armband, but once this armband was delivered, it was soon apparent to me that while both improvements worked as hoped, the armband was not fully functional for two primary reasons. First, although the external straps could now be pulled extremely tight because of a looping mechanism, the actual armband and the straps needed to be respectively smaller and shorter to avoid excess overlap of material as a result of the tightened fit. Second, because the optional shoulder harness was not padded, it rapidly became very painful and chaffed the underarm area during use.

The result was a third version of the armband; this time with shorter straps (explained below), a smaller overall width, and slightly larger openings into the elbow area to increase flexibility. The slightly smaller width of the armband, the shorter straps and the larger elbow region openings all worked as hoped. The armband could now be secured more tightly and effectively so that the detachable shoulder harness is not strictly necessary all of the time. However, when I undertook an exercise program that focused on lifting much heavier weights and increased utilization of a suspension training (TRX) harness for suspension-related and resistance-related exercises, the shoulder strap became necessary because of the both heavier weight and exercises involving heavier, sustained weight. Once this new exercise program commenced it soon became apparent that further improvements were needed. First, the shorter cinch straps were now too long because they were being pulled tighter and past the spots where the Velcro® would secure. Second, the leather loops which secured the D-rings to the upper side of the leather trapezoid began to show a significant amount of stretching. Third, the shoulder harness showed mild stretching in the area where the snaps were secured; plus there was also now an issue of whether three snaps would be sufficient. Fourth, the increased pressure on the armband from the use of increase weight started to result in the breaking of the metal rivets that secured the metal D-rings in place.

Figure 2:
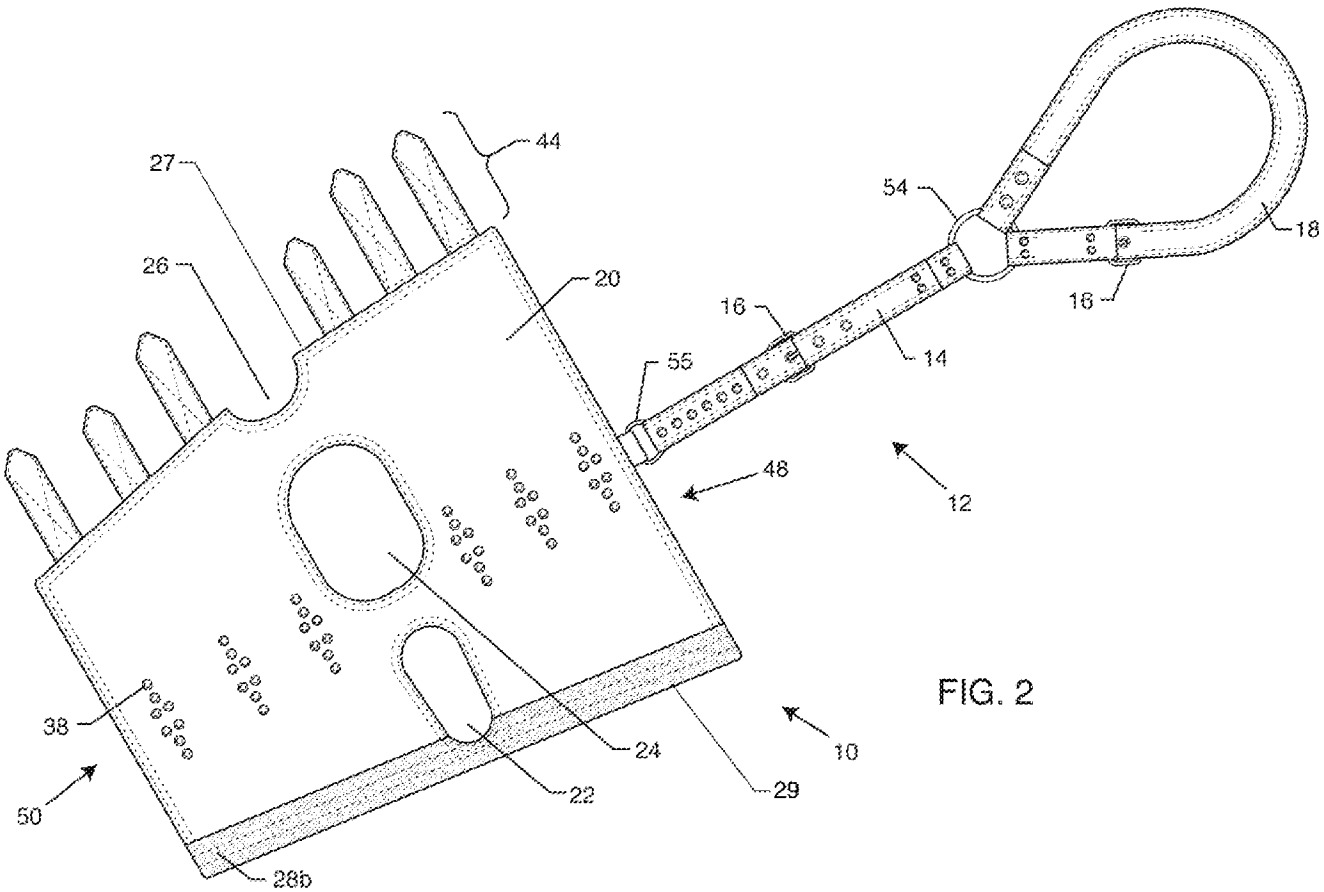
FIG. 2 shows a view of the lower surface of the device in an unrolled condition.

As a result I designed another armband that incorporated improvements to overcome these problems. The cinching straps were measured for a more exact fit, and two-ply leather with additional stitching was used to secure the ring that attaches the shoulder harness to the armband. Two additional rivets were installed on each side of each D-ring, so that each D-ring was now secured by eight rivets. This embodiment is shown in FIGS. 1 and 2. This has increased security and stability and has decreased stretching. In addition, the shoulder harness for the fifth armband is secured by six snaps 41, an increase of three snaps from previous version of the shoulder harnesses. The result of all of these improvements were as hoped; the armband may now secured very tightly around the arm and the shoulder harness is more secure and has less "give." The armband can now be confidently used to lift much heavier weights without being pulled off or even pulled down the arm, and the ability to perform suspension exercises involving suspension from the harness of a suspension training device is greater than before.

Details of drawings. As shown in FIG. 1 a recent embodiment of the armband device 10 is a 3-ply leather trapezoid 20 with reinforcing stitching 42 to laminate the plies and stabilize the edges. It will be appreciated that a different number of plies can be used and lamination can be achieved by adhesives or other methods well-known in the art. Besides their functional purpose, the stitching 42 also contributes to the esthetic aspects of the device. The basic flat piece of material 20 is trapezoidal in general shape to accommodate the tapering of the arm from the shoulder to the wrist. An optional shoulder strap 12 is attached to the shoulder end 48 of the trapezoid 20 by means of a ring 55. The shoulder strap 12 consists of a padded arm loop 18 attached to a longitudinal strap 14. The strap 14 is removably attachable to the ring 55 by means of snaps 41. Both the padded arm loop 18 and the longitudinal strap 14 have buckles 16 which interact with eyelets 40 to adjust the padded arm loop 18 and the longitudinal strap 14. Other types of length adjustments such as hook in loop fastener can be used to achieve ready length adjustment.

A spaced apart series of cinching straps 30 are attached to the surface of the trapezoid 20. Each strap 30 originates at a fixed end 46 near a first longitudinal edge 27 of the trapezoid 20 and extends across the entire trapezoid 20 parallel to the shoulder end 48. At the origin of each strap 30 a metallic rectangular cinching ring 34 is attached between the strap 30 and the trapezoid 20 by a number of rivets 38. As will be appreciated by one of ordinary skill in the art, different types of rivets may provide additional strength or resilience. Currently stainless steel rivets are used but rivets of titanium or other metals can be used. The fixed ends 46 of successive straps 30 are slightly staggered or offset so that the fixed ends 46 of straps 30 nearer to the shoulder end 48 are somewhat closer to the first longitudinal edge 27 whereas those straps 30 farther from the shoulder end 48 have origins slightly farther from the first longitudinal edge 27. The lengths of the straps 30 vary according to each strap's position. This is to accommodate the taper of the arm and to improve the tightness of the device 10 when the straps are cinched. Each strap 30 has a free end 44 that overhangs the second longitudinal edge 29. The free ends 44 bear two regions 32*a*, 32*b* of complementary Velcro® brand of hook in loop fastener. Each strap 30 also bears a D-ring 36 approximately half way between the tip of the free end 44 and the fixed end 46. Each D-ring 36 is held in place between the upper surface of the trapezoid 20 and the cinching strap 30 by rivets 38.

The length of the trapezoid 20 is approximately equivalent to the distance from the shoulder proximal to the juncture of the upper arm and the shoulder to the wrist (wrist end 50 proximal to the wrist). In use the trapezoid 20 is wrapped around the user's arm to form a tube. One longitudinal edge of the trapezoid 20 bears a strip 28*a* (about 2.5 inches wide) of Velcro® brand of hook in loop fastener. This strip 28*a* interacts with a complementary strip 28*b* on the lower surface of the leather trapezoid 20 (see FIG. 2). This configuration enables a user to wrap the armband snugly around the arm and position it with a reasonable degree of stability and precision (i.e., the user easily attain the desired positioning of the stainless steel D-rings 36) before the cinching straps 30 are secured. There are two oval-shaped opening cut into the center of the armband to allow the elbow to flex normally. A larger opening 22 accommodates the oleocranon process of the ulna (the pointed tip of the elbow joint) while a smaller opening 24 exposes the inner aspect, the antecubital fossa, of the joint. The second longitudinal edge 29 bears a partial cutout 26 that corresponds in dimension to the smaller opening 24. Over a reasonable period of normal use the armband will "break in" and become more comfortable by "molding" itself to each individual user's physique.

Figure 3:
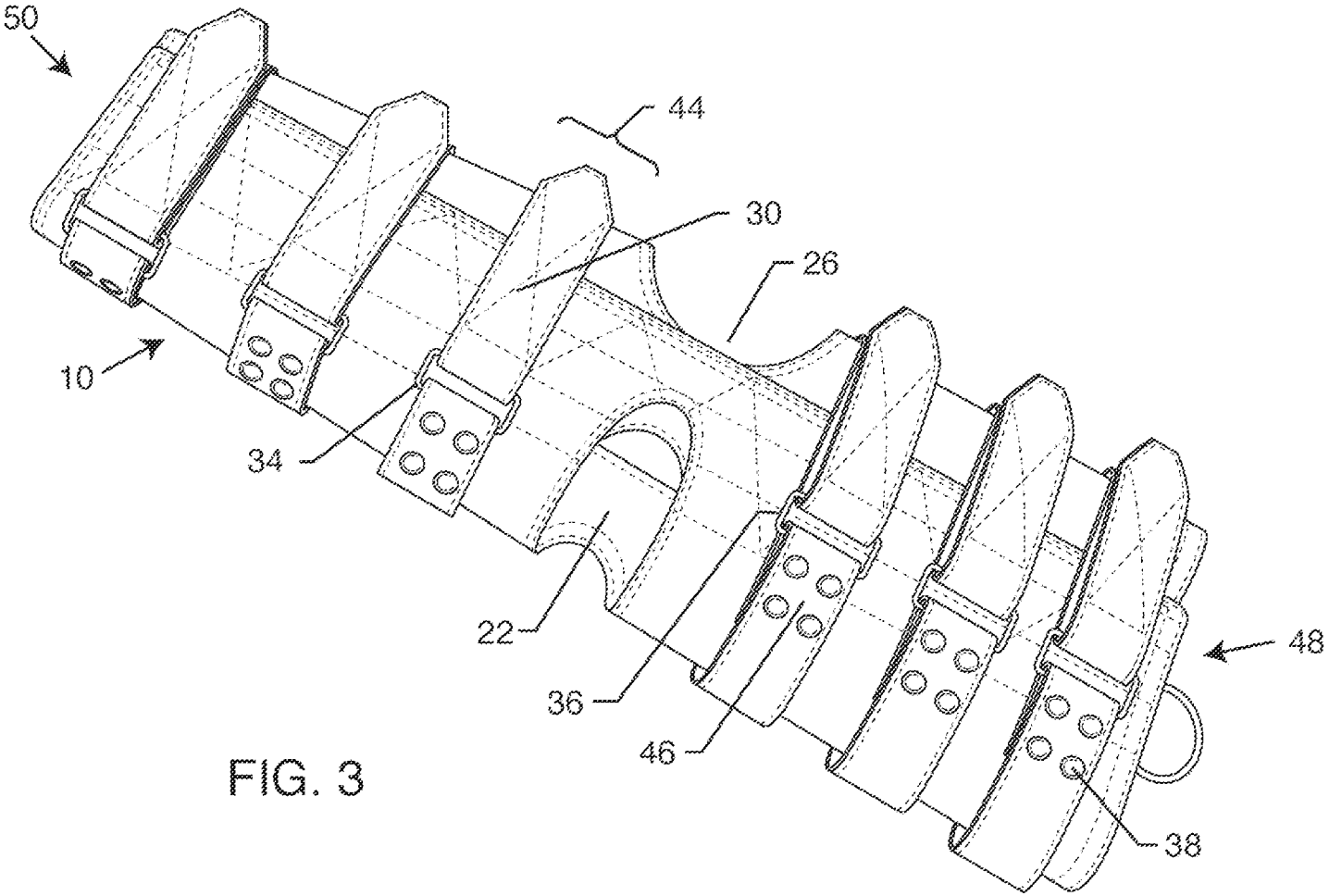
FIG. 3 shows a view of the device rolled up to accommodate an arm of the user.

As shown in FIG. 3 the device 10 is used by wrapping it into a tube that encloses the users arm and prosthesis. This is initially accomplished by wrapping the device 10 around the arm with the larger opening 22 placed to allow the point of the elbow to pass through it when the elbow is flexed. The longitudinal edges 27, 29 are overlapped so that the hook-in-loop strips 28*a*, 28*b* interact. This is done in such a manner as to make the fit of the device 10 snug about the arm. The partial cutout 26 is coincident with the smaller opening 24. At this point the cinching straps 30 are tightened by running the tip of the free end 44 of the strap 30 through the rectangular stainless steel ring 34 at the fixed end 46 of that strap and pulling the strap tight. The strap 30 is then doubled up over the ring 34 so that the complementary regions of hook-in-loop fastener 32*a*, 32*b* interact and hold the strap 30 in the tightened state. Although there are six straps 30 shown on this particular embodiment of the armband device 10, the exact number of cinching straps 30 can be increased or decreased depending on the requirements (e.g., size and strength) and/or preferences of each user. As explained above, there can be advantages to reinforcing portions of the straps and/or adjusting the lengths of the straps.

The armband device 10 bears six stainless steel D-rings 36 (one for each cinching strap 30) that are incorporated into the cinching straps 30 and are secured by stainless steel rivets 38. The D-rings 36 are positioned so that they may be attached directly to cables of weight machines and permit the user to perform exercises, stretches or other physical activities that may not otherwise be possible because of disability, injury or other pre-existing condition that prevents the wearer from affecting a "normal" grip with a human hand.

The D-rings 36 in the illustrated embodiment are located at equally spaced intervals along the armband to allow for multiple options when the user connects the armband to a weight machine cable or other exercise cable. While this embodiment contains six D-rings 36 running up the outside of the arm at equally spaced intervals, the number of D-rings and their placement can be altered to fit the requirements and preferences of each individual user. It will be apparent to one of ordinary skill in the art that there is no necessary relation between the number and position of the D rings 36 and the cinching straps 30. There can be more than one D-ring 36 per strap 30 or than can be straps 30 with no D-ring 36. The D-rings 36 can also be located on the surface of the trapezoid 20 at locations not coincident with the cinching straps 30.

Figure 4:
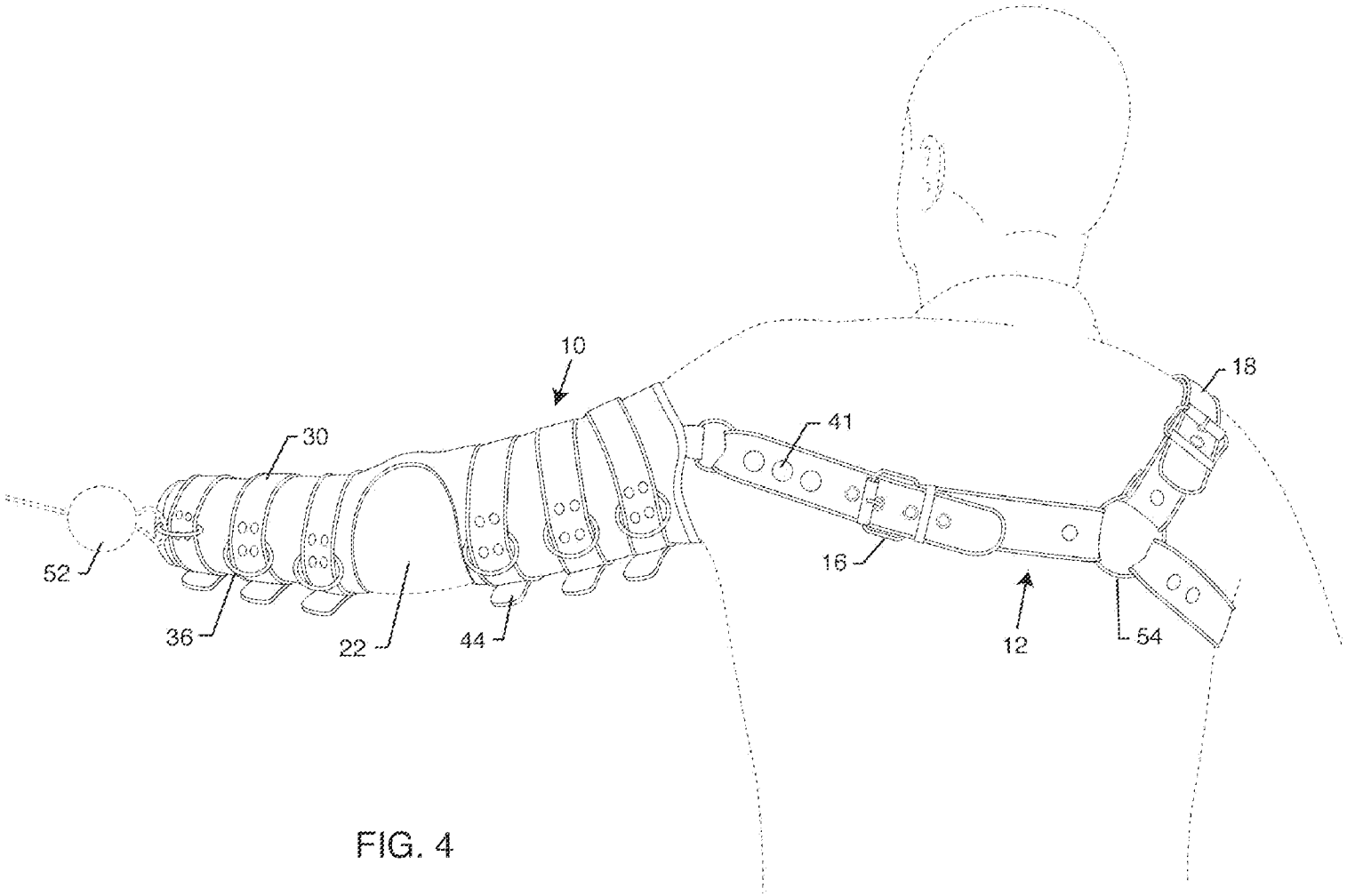
FIG. 4 shows a back view of a user (in phantom line) utilizing the device.

FIG. 4 shows a user (in phantom line) wearing the device 10 on his left arm. Note that the elbow backside (the "point" of the elbow joint) is located within the large opening 22. The armband 10 is completed by an optional detachable shoulder harness 12, which attaches to the armband via a separate stainless steel D-ring. The first section of the strap 14 loops through this D-ring and is secured by three button snaps 41. The strap 14 of the optional, detachable shoulder strap 12 passes across the user's back and it extends to a circular stainless steel ring 54. The stainless steel circular ring 54 connects to a separate, heavily padded leather loop 18 that extends around the wearer's opposite shoulder and prevents the armband from being pulled off.

Here the user has placed his right arm through the heavily padded arm loop 18 so that the loop 18 goes over his right shoulder and passes around the arm through the underarm region. This arrangement prevents the armband device 10 from being inadvertently pulled off during exercise. Should the user require two armband devices 10 (i.e., one for each arm) a modified harness (not illustrated) can be provided to join the two padded arm loops 18 together and to connect to the devices 10—one on each arm. In actual use, the cinching strap arrangement proves to be so effective that the shoulder strap 12 can often be dispensed with (i.e., the device 10 is held so tightly to the arm that it cannot be readily pulled off). The requirement for the shoulder strap 12 depends on user preference and the type of exercise being carried out.

Figure 5:
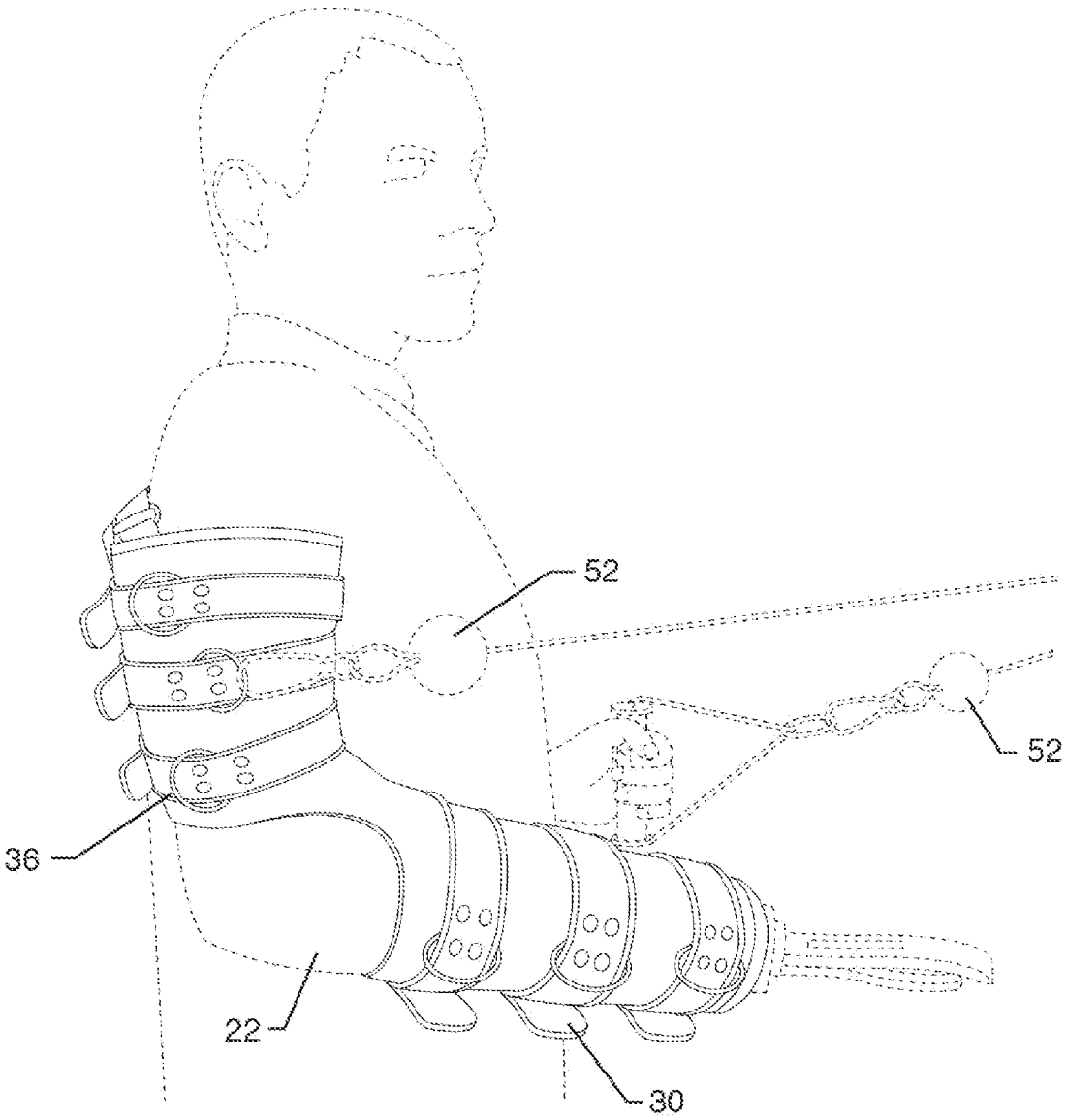
FIG. 5 shows a side view of a user (in phantom line) utilizing the device.

FIG. 5 shows a side view of another user (in phantom line) wearing the device 10 on his right arm. Notice that the user's elbow point is accommodated by the larger opening 22 to ensure flexibility of the joint. In this example, a cable 52 from an exercise machine is attached to one of the D-rings 36 on the upper arm portion of the device 10. This placement allows performance of a pulling-type exercise. This is the same exercise the user would perform by using his prosthetic hand to grasp a handle attached to the exercise machine cable. In some cases, the tight grip of the device 10 reinforces the connection between the user's prosthetic hand and the arm to such a degree that some pulling exercises can be executed using the prosthetic hand rather than a connection to the D-rings 36.

The "exercise machine" discussed above includes complex machines found in gyms as well as simple cable and pulley arrangements. In addition, D-rings 36 of the device 10 can be attached to suspension training devices (such as the TRX Suspension Trainer a product of Fitness Anywhere of San Francisco, Calif.) via the use of mountain climbing clamps and cables or similar hardware to perform suspension-related or resistance-related exercises that would usually require two hands to perform.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

I claim:

1. An armband exercise device for use while wearing a prosthesis for permitting exercise of an entire arm comprising:

a four-sided sheet of leather of at least two plies or flexible and inelastic fabric having a first surface, a second surface, an upper edge, a lower edge, a first side edge and a second side edge wherein a length from the upper edge to the lower edge measured along a longitudinal axis is sized to be about equal to a length of a user's arm from shoulder to wrist;

a first opening cut through the four-sided sheet, disposed and sized to accommodate an outer surface of an elbow joint when the device is wrapped around the user's arm;

a second opening cut through the four-sided sheet, disposed and sized to accommodate an inner surface of an elbow joint to promote flexibility when the device is wrapped around the user's arm;

a first strip of hook-and-loop fastener along the first side edge of the first surface and a second strip of hook-and-loop faster complementary to the first strip along the second side edge of the second surface with the first strip and the second strip interacting to hold the device in a wrapped position when the device is wrapped around the user's arm with the side edges overlapping;

a plurality of cinching straps including hook-and-loop fastener, each strap extending from a fixed end attached to the four-sided sheet near the second side edge running perpendicular to the longitudinal axis of the four-sided sheet to a free end near the first side edge;

a plurality of cinching rings, at least one per cinching strap, each ring attached to the device and disposed so that pulling the free end of each cinching strap through its respective cinching ring tightens the device when wrapped around the user's arm and the prosthesis with the hook-and-loop fastener on the cinching straps maintaining the device in a tightened state so that strength, inflexibility and tightness of the device reinforces connection with the prosthesis and prevents the prosthesis from being pulled off; and a plurality of attachment hardware attached to the device to enable pulling and lifting exercise as well as suspension and suspension training.

2. The armband exercise device according to claim 1, wherein the fabric is woven from para-aramid fibers.

3. The armband exercise device according to claim 1, wherein the four-sided sheet is trapezoidal in shape with the upper edge being essentially parallel to the lower edge.

4. The armband exercise device according to claim 1 further comprising a notch in one of the side edges disposed to coincide with the second opening when the device is wrapped around the user's arm.

5. The armband exercise device according to claim 1, wherein the at least one cinching ring per cinching strap is disposed in proximity to the fixed end of the cinching strap.

6. The armband exercise device according to claim 1, wherein the attachment hardware comprises D-rings.

7. The armband exercise device according to claim 6, wherein there is one D-ring per cinching strap.

8. The armband exercise device according to claim 1, further comprising a shoulder harness.

* * * * *